US009206539B2

(12) United States Patent
Kim et al.

(10) Patent No.: US 9,206,539 B2
(45) Date of Patent: Dec. 8, 2015

(54) WASHING MACHINE HAVING WASHING COURSE FOR SHOES

(75) Inventors: Hyung Yong Kim, Gyeongsangnam-do (KR); Eun Jin Park, Gyeongsangnam-do (KR); Dong Woo Kang, Gyeongsangnam-do (KR); In Ho Cho, Gyeongsangnam-do (KR); Deug Hee Lee, Gyeongsangnam-do (KR); Pyoung Hwan Kim, Gyeongsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 437 days.

(21) Appl. No.: 12/431,466

(22) Filed: Apr. 28, 2009

(65) Prior Publication Data

US 2010/0058814 A1 Mar. 11, 2010

(30) Foreign Application Priority Data

Apr. 29, 2008 (KR) ..... 10-2008-0039859

(51) Int. Cl.
*D06F 35/00* (2006.01)

(52) U.S. Cl.
CPC ..... *D06F 35/006* (2013.01); *D06F 2204/065* (2013.01); *D06F 2214/00* (2013.01)

(58) Field of Classification Search
USPC ..... 8/158, 159; 68/12.12
See application file for complete search history.

(56) References Cited

U.S. PATENT DOCUMENTS

| | | | | |
|---|---|---|---|---|
| 6,856,841 | B2 * | 2/2005 | Peterson | 700/19 |
| 2003/0208855 | A1 | 11/2003 | McAllister et al. | |
| 2004/0006829 | A1 * | 1/2004 | Kim | 8/150 |
| 2006/0048548 | A1 | 3/2006 | Park et al. | |

FOREIGN PATENT DOCUMENTS

| | | | |
|---|---|---|---|
| CN | 1087693 | A | 6/1994 |
| CN | 2595838 | Y | 12/2003 |
| CN | 1528234 | A | 9/2004 |
| CN | 101082166 | A | 12/2007 |
| EP | 1 380 682 | A2 | 1/2004 |
| KR | 1998-041183 | A | 8/1998 |
| KR | 10-2004-0006252 | A | 1/2004 |
| KR | 10-0473320 | B1 | 3/2005 |
| KR | 10-2006-0023067 | A | 3/2006 |
| RU | 20517 | U1 | 11/2001 |
| WO | WO 2006098571 | A1 * | 9/2006 |

* cited by examiner

*Primary Examiner* — David Cormier
(74) *Attorney, Agent, or Firm* — Birch, Stewart, Kolasch & Birch, LLP

(57) ABSTRACT

The present invention relates to washing machines, and, more particularly, to a washing machine in which a drum that holds laundry is rotated with respect to a substantially horizontal rotation shaft. The washing machine includes a shoe course selection unit for enabling a user to select a shoe course, and a controller for controlling operation of the washing machine to wash shoes while swinging the drum within 90° in left/right directions if the user selects the shoe course.

8 Claims, 3 Drawing Sheets

WASHING MACHINE HAVING WASHING COURSE FOR SHOES

CROSS REFERENCE TO RELATED APPLICATION

This application claims the benefit of the Korean Patent Application No. 10-2008-0039859, filed on Apr. 29, 2008, which is hereby incorporated by reference as if fully set forth herein.

BACKGROUND OF THE DISCLOSURE

1. Field of the Disclosure

The present invention relates to washing machines, and, more particularly, to a washing machine in which a drum that holds laundry is rotated with respect to a substantially horizontal rotation shaft.

2. Discussion of the Related Art

In general, the washing machine is an apparatus for washing clothes. However, an apparatus may be called as the washing machine that, not only performs a washing function, but also performs a drying function or a refreshing function by supplying steam. If the laundry is introduced to the drum, the washing machine performs operation (will be called as washing operation for convenience's sake) for washing, drying, or refreshing the laundry by using various components mounted to an inside of the washing machine.

In the washing machines, there is a vertical shaft type washing machine in which an upright drum rotates round a vertical shaft, or a pulsator in the drum rotates round a vertical shaft for washing laundry. This will be called as a pulsator type washing machine for convenience's sake. And, there is a horizontal shaft type washing machine in which the drum is laid down to rotate round a substantially horizontal rotation shaft for washing the laundry. This will be called as a drum type washing machine for convenience's sake.

Since the drum type washing machine performs washing by using less water than the pulsator type washing machine, and has a low resistance caused by the washing water when the drum rotates, the drum type washing machine is economical compared to the pulsator type washing machine. Accordingly, currently the drum type washing machine is preferred to the pulsator type washing machine.

In the meantime, the pulsator type washing machine washes the laundry after the laundry is submerged in the washing water fully from the view point of structure. Therefore, besides the general water washing, performance of drying or refreshing function is not easy.

The drum type washing machine has a variety of washing courses depending on washing objects or purposes. For an example, the drum type washing machine may have a variety of courses, such as a functional clothes course for washing clothes, such as lingerie, or mountain-climbing clothes, blanket course, a wool course, and so on.

Depending on the washing purposes, the drum type washing machine may also have a variety of courses, such as an allergy care course which sterilizes the laundry by using steam, steam cleaning course for refreshing dried laundry or partially wet laundry by using steam and hot air, and so on.

Of the washing courses, there is a normal course which is used generally.

The washing courses are in the washing machine as programs. Accordingly, a controller controls the washing machine according to a program for the washing course selected for performing the washing course.

In general, the washing course can be selected by using a dial type of course selection unit. For the user to select options on the washing courses, an option selection unit may be provided to the washing machine.

The option selection unit is provided for selection of a water temperature, rinsing conditions, spinning conditions, and so on. For an example, at the option selection unit, the water temperature can be selected, a preliminary washing, soaking and so on can be selected as the washing conditions, a number of rinsing times or spinning RPM can be selected.

Recently, a washing machine that washes by using steam is widely known and used. The washing machine that washes by using steam is provided with a steam selection unit which enables to select use of the steam for some of preset washing courses. A washing machine having a drying function is provided with a drying selection unit for selection of laundry dry.

Though a related art washing machine is provided with a variety of washing courses, a washing course exclusively for shoes are not provided. Therefore, most consumers wash the shoes, manually. Or, recently as there are laundry shop exclusively for shoes, people also use the shoe laundry shop.

Some of the consumers wash the shoes by using a related art washing course. However, the shoe washing by using a related art washing course is liable to damage, not only the shoes, but also the washing machine. Because, different from general laundry, the shoes has a weight, not distributed, but concentrated, there can be great noise and impact caused by the shoes when the drum rotates.

SUMMARY OF THE DISCLOSURE

Accordingly, the present invention is directed to a washing machine having a washing course for shoes.

An object of the present invention is to provide a washing machine having a washing course for shoes which can washes shoes. In addition to this, another object of the present invention is to provide a washing machine having a washing course exclusively for washing shoes separate from other washing courses. The course is called as a shoe course in the specification.

The shoes in the present invention are a general term for footwear that can be washed with water, rather than calling shoes only.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes a shoe course selection unit for enabling a user to select a shoe course, and a controller for controlling the washing machine to wash shoes while swinging the drum.

The swing is driving of the drum in an extent the shoes do not tumble. For an example, the drum is rotated in regular/reverse directions within a range of 120° to swing the drum.

A ratio of a swing time period to a pausing time period of the drum may be controlled to be 6:15 at least in a section of the washing course or the rinsing course. In a case the drum is driven by controlling a motor which drives the drum, a ratio of a turn-on time period to a turn-off time period of the motor is called as an actual moving time ratio. Above actual moving time ratio is 6:15. For an example, the drum may be swung for 6 seconds, and pause for 15 seconds.

The controller can control the drum to tumble at least in a section of the washing course or the rinsing course. The tumbling of the drum is driving the drum such that the laundry in the drum tumbles. Different from general laundry, the shoes can be damaged if the shoes are kept to tumble. Moreover, the tumbling of the shoes can damage the washing machine for some extent. Therefore, the tumbling can be performed in an extent required for the washing of the shoes.

The controller can control the drum to tumble at every fixed number of swing times. For an example, the fixed number of swing times may be 5 times.

The controller can control the drum to make the ratio of tumbling time period to the pausing time period to be 3:15 at least in a section of the washing course.

The controller can control a circulation pump to be kept in a turned off state in the washing course or the rinsing course. The shoes can contain grains of soil, which can be transferred to the washing water. In this instance, if the washing water is circulated by using the circulation pump, the grains can be accumulated in the circulation flow passage to block the circulation flow passage. The grains can be discharged from the circulation flow passage in a washing thereafter to contaminate the laundry.

The shoe course selection unit includes a first selection unit for enabling the user to select one of a plurality of washing courses, and a second selection unit for enabling the user to select shoe washing.

The shoe course selection unit may be of one touch type, or multiple touch type.

The first selection unit may be a course selection unit for selection of a washing course, and the second selection unit may be an option selection unit for selection of options from each of the washing courses.

If there are many washing courses which can be selected at the course selection unit already, addition of the shoe course thereto may be difficult. Therefore, it can be made such that the shoe course is selected by using both the course selection unit and the option selection unit together.

In this instance, it can be made such that the shoe washing can be selected at the second selection unit only when a washing course set already is selected at the first selection unit. The washing course set thus may be the normal course.

It can be set such that, if the washing course is changed at the first selection unit after the shoe washing is selected at the second selection unit, the selection of the shoe washing is removed.

It can be set such that, if the shoe washing is selected at the second selection unit, selection of some of washing conditions may not be permitted. The conditions may be ones that is not suitable for the shoe washing. For an example, it can be set, of the washing conditions, at least one of preliminary washing course, soaking course, and baby clothes course can not be selected.

The washing machine may further include a third selection unit which enables selection of use of steam or drying, wherein it can be set such that, if the shoe course is selected, the use of steam or the drying can not be selected.

The controller can control the washing course not to perform an intermediate spinning in the middle of the washing course.

The controller may control such that the shoe course can be performed regardless of a laundry amount. That is, operation conditions of the shoe course do not change depending on an amount of the laundry. If a sensor for sensing the amount of the laundry is provided, the controller may be set such that the amount of laundry is not sensed in the shoe course. In a case a laundry amount input unit is provided for enabling the user to input the laundry amount, the laundry amount input unit may not be activated in the shoe course, and, it may be set such that, even if the laundry amount is received through the laundry amount input unit, the controller disregards the laundry amount received thus.

The controller may be set such that the controller performs the shoe course in conditions of a washing water temperature to be at 38~42° C., a number of rinsing times of 3 times, and a maximum drum rotation speed of below 400 rpm in the spinning.

Thus, the present invention provides a washing machine having a new washing course that can wash shoes. Accordingly, consumers can wash shoes domestically without manual shoe washing or using an exclusive shoe washing laundry shop.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
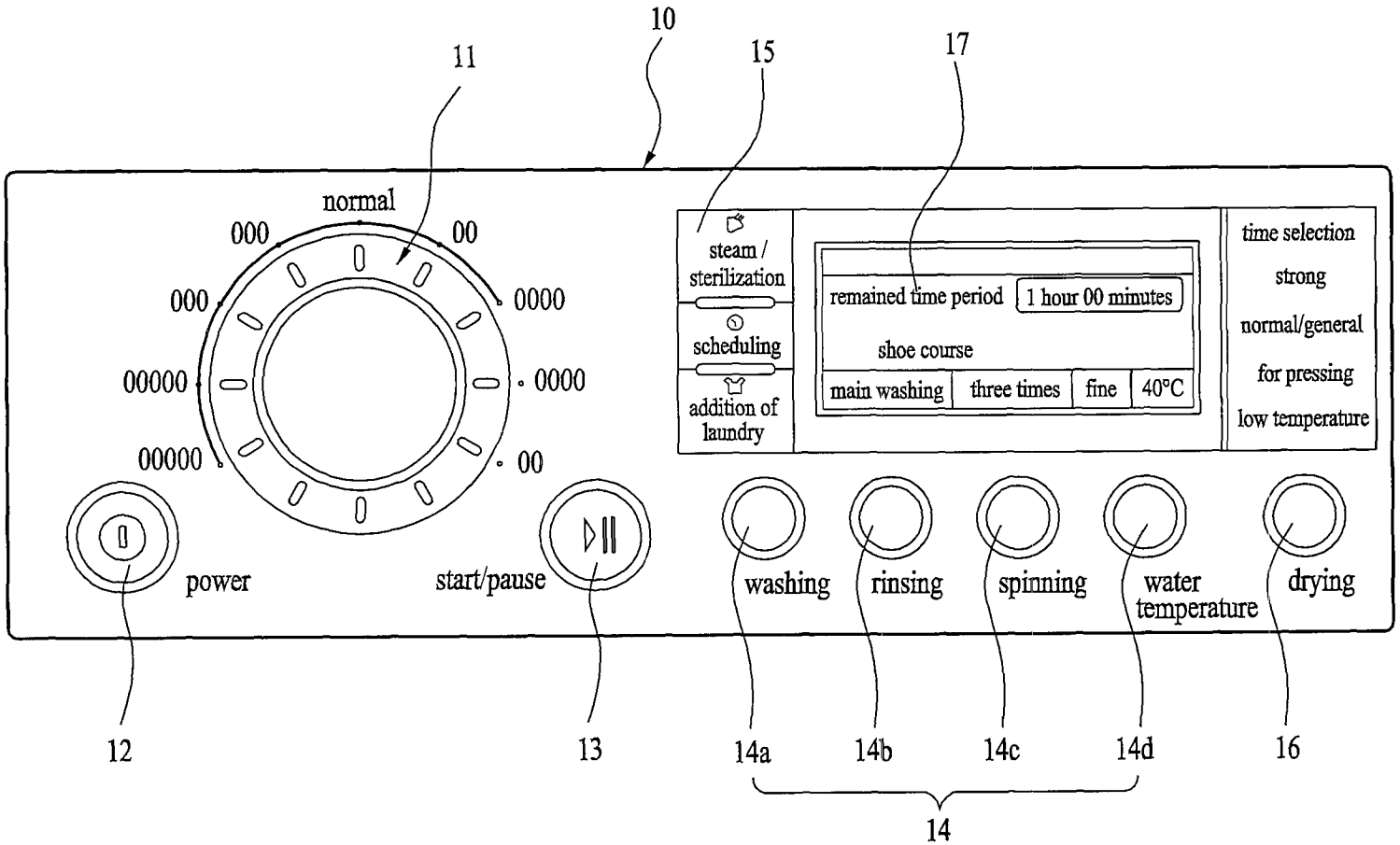
FIG. 1 illustrates a control panel of a washing machine in accordance with a preferred embodiment of the present invention.

FIG. 1 illustrates a control panel 10 of a washing machine in accordance with a preferred embodiment of the present invention. The control panel 10 has a course dial 11 and an option selection unit 14 as a course selection unit.

The control panel 10 also has a display window 17 for displaying information on the washing course to the user, a steam selection unit 15 for selecting use of the steam, a drying selection unit 16 for selecting drying, and a power source button 12 and a starting button 13.

The course dial 11 is provided for selecting various washing courses, so that the user turns the course dial 11 for selecting a desired washing course.

The option selection unit 14 is for selecting detailed conditions of the washing courses, such as washing, rinsing, spinning, water temperature, and so on.

At the washing option selection unit 14*a*, main washing, preliminary washing, soaking, no washing, shoes, baby clothes, and so on can be selected.

At the water temperature option selection unit 14*d*, a water temperature, such as cold water, 30 degrees, 40 degrees, and so on can be selected.

At the rinsing option selection unit 14*b*, a number of rinsing times, such as no rinsing, one time, two times, three times, four times, five times, and so on, can be selected.

At the spinning option selection unit 14*c*, an extent of spinning, such as no spinning, fine, weak, middle, strong, the strongest, and so on, can be selected. The extent of spinning is related to a rotation speed of the drum at the time of spinning.

The shoe course can be selected at the course dial 11. For an example, alike a normal course, a blanket course, and a wool course, the shoe course can be selected as one independent course.

Once the shoe course is selected at the course dial 11, the controller operates the washing machine according to a preset program.

The shoe course may be selected at the course dial 11 and the washing option unit 14*a*.

If the normal course is selected at the course dial 11 and the shoe is selected at the washing option selection unit 14*a*, the shoe course can be selected. The controller is set such that no shoe is selected at the washing option selection unit 14*a* in a state a course other than the normal course is selected at the course dial 11.

The controller may be set such that the selection of the shoe course is removed if the washing course is changed at the course dial 11 after the shoe course is selected according to above method. Of course, the controller may be set such that, after the selection of the shoe course, only a washing course set already is selected at the course dial 11, or a washing course is changed to the washing course set already. The washing course set already may be the normal course, described before.

The controller is set such that no other washing options can be selected if the shoe is selected at the washing option selection unit 14*a*.

It is preferable that use of the steam or drying can not be selected in the shoe course. Because the shoe may be formed of synthetic fiber or natural rubber which is weak to heat. According to this, damage to the shoes due to selection of the steam or the drying can be prevented in advance.

In the shoe course, with regard to the water temperature, 40° C. is set as default, with regard to the rinsing option, 3 times is set as default, and with regard to the spinning option, fine is set as default. In this instance, the fine in the spinning option has a rotation speed of the drum set at 400 rpm in the spinning.

Those settings are made taking shoes into account as a washing object. Since the shoes can be weak to heat, it is required to prevent the water temperature from being set excessively high. Moreover, taking vibration and noise into account, it is required to prevent a spinning RPM from being set excessively high. Therefore, preferably it is made that the user can not select an option significantly departing from the water temperature option and the spinning option. However, different from this, the user may select the rinsing option, freely.

Figure 3:
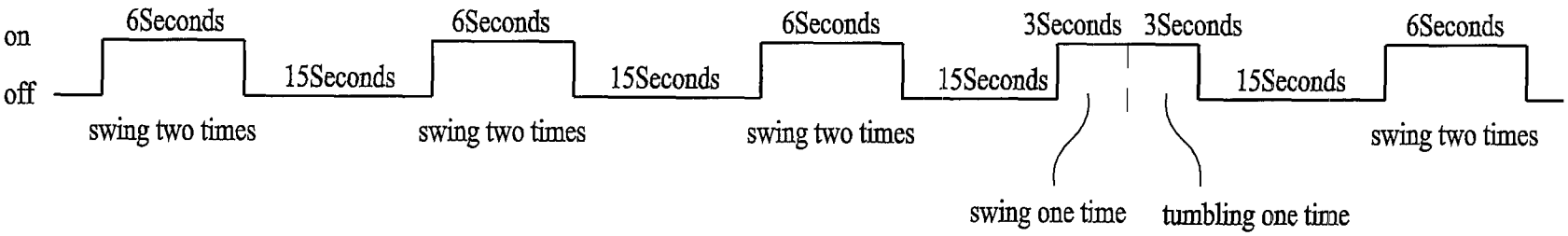
FIG. 3 illustrates a moving pattern of a drum in a washing or rinsing course.

In the shoe course, the washing course is set to 30 minutes, and operation pattern of the drum is as shown in FIG. 3. That is, as shown in FIG. 3, the drum is set to repeat swing for 6 seconds and pausing for 15 seconds, and tumbling for 3 seconds at every 7 times of swing.

Figure 2:
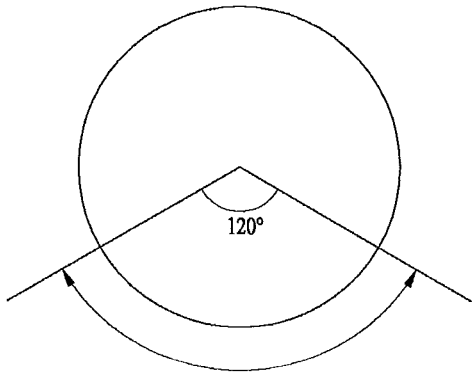
FIG. 2 illustrates swing of a drum, schematically.

The swing of the drum can be made within a range of 90° in left/right directions. This is because, if the left/right direction swing angle exceeds 90°, an impact caused by the drop of the shoes can be applied to the drum continuously. Therefore, as shown in FIG. 2, it is preferable that the swing of the drum is in a range of 60° in regular/reverse directions. One time of regular/reverse direction swing is counted as one time.

The rotation speed of the drum at the time of the tumbling is set to be 46 rpm. The tumbling of the drum is made for mixing the shoes in the drum for making uniform washing. The tumbling can enhance a washing effect of pounding of the laundry for some extent.

It is preferable that an intermediate spinning is not made in the washing course. This is for minimizing impacts applied to the drum throughout entire shoe course as far as possible.

Moreover, it is preferable that the controller is set to make no washing water circulation. The washing water circulation is re-supply of the washing water from the tub to an upper portion of the drum by pumping.

Different from general laundry, the shoes can have large dirt, such as sand or the like present therein, and alikely, dirt, such as sand, stone and gum stuck to an underside thereof. Accordingly, it is liable that the large dirt separated from the shoes can block a washing water circulation flow passage. Due to this reason, it is preferable that the controller is set to make no washing water circulation. Therefore, it is preferable that the circulation pump is kept turned off during the washing course of the shoe course.

After the washing course is performed for the set time period, the washing water is drained, and operation of the washing machine proceeds to the rinsing course.

An operation pattern of the drum in the rinsing course can be identical to the same in the washing course.

The rinsing course is performed for a set time period of 7 minutes. Neither intermediate spinning, nor rinsing spinning, is performed in the rinsing course, too. The rinsing spinning is brief spinning performed right after finishing the rinsing before operation of the washing machine proceeds to the spinning course which is final spinning.

In the shoe course, the spinning is made only in the spinning course finally, but is performed neither in the washing course nor the rinsing course.

In the rinsing course, a number of rinsing times in which the washing water is supplied, then the drum is put into operation to perform the rinsing, and the washing water is drained is performed according to user's selection. As described before, 3 times is set as default.

A time period required for one time of rinsing is set. The more the number of the rinsing times, the longer an entire rinsing time period. It is preferable that no washing water circulates, and the circulation pump is kept turned off in the rinsing course.

After finishing the rinsing, the operation of the washing machine proceeds to the spinning course. In the spinning course, the spinning is performed according to selected extent of spinning.

In the spinning course, 'fine' is set as default. In the 'fine', the rotation speed of the drum is set to be 400 rpm in a regular spinning section.

The spinning course is performed for a preset time period, and in the embodiment, the preset time period is 10 minutes.

In the meantime, it is preferable that the washing course and the rinsing course in the shoe course are performed regardless of a laundry amount. That is, it is preferable that setting time periods of the washing course and the rinsing course are the same respectively regardless of the laundry amount. Alikely, it is preferable that washing water levels of the washing course and the rinsing course are set the same respectively regardless of the laundry amount. The washing water level can be the highest water level allowable to the washing machine. Because, different from general laundry, it is preferable that the shoes are washed or rinsed with most of the shoes submerged in the washing water. This is because most of the shoe course is the swing of the drum. Owing to the swing of the drum, the washing water washes in the drum, to pound the shoes, this enhances a washing effect.

Moreover, the higher the washing water level, the shoes dropped at the time of tumbling, applies the less impact to the drum directly, and hits the washing water to distribute the impact. Of course, the impact to the washing water can enhance the washing effect.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a first selection unit for enabling a user to select one of a plurality of washing courses;

a second selection unit for enabling the user to select a shoe washing course;

a drum for holding laundry; and a controller configured to cause the drum to repeat a swing to rotate the drum within 60° in left/right directions and a tumbling to rotate the drum exceeding 90° in left/right directions when the shoe washing course is selected by the second selection unit, wherein the second selection unit has an activated state and a deactivated state, and wherein the controller puts the second selection unit in the activated state when a preset washing course that does not supply steam or heated air to the laundry is selected by the first selection unit and in the deactivated state when a preset washing course that supplies steam or heated air to the laundry is selected by the first selection unit.

2. The washing machine as claimed in claim 1, wherein the first selection unit is a course selection unit for selection of a washing course, and the second selection unit is an option selection unit for selection of options for each of the washing courses.

3. The washing machine as claimed in claim 1, wherein the preset washing course is a normal course.

4. The washing machine as claimed in claim 3, wherein the selection of the shoe washing course is canceled when the washing course is changed into a washing course that supplies steam or heated air to the laundry by the first selection unit after the shoe washing course is selected by the second selection unit.

5. The washing machine as claimed in claim 1, wherein only a preset washing course can be selected by the first selection unit when the shoe washing course is selected by the second selection unit.

6. The washing machine as claimed in claim 1, further comprising a third selection unit which enables selection of use of steam or heated air, wherein the third selection unit is inactivated when the shoe washing course is selected such that the use of steam or heated air cannot be selected.

7. A washing machine comprising:

a first selection unit for enabling a user to select one of a plurality of washing courses;

a second selection unit for enabling the user to select a shoe washing course;

a drum for holding laundry; and a controller configured to cause the drum to repeat a swing to rotate the drum within 60° in left/right directions and a tumbling to rotate the drum such that the laundry in the drum tumbles when the shoe washing course is selected by the second selection unit, wherein the second selection unit has an activated state and a deactivated state, and wherein the controller puts the second selection unit in the activated state when a preset washing course that does not supply steam or heated air to the laundry is selected by the first selection unit and in the deactivated state when a preset washing course that supplies steam or heated air to the laundry is selected by the first selection unit.

8. A washing machine comprising:

a first selection unit for enabling a user to select one of a plurality of washing courses;

a second selection unit for enabling the user to select a shoe washing course;

a drum for holding laundry; and a controller configured to cause the drum to repeat a swing to rotate the drum within 60° in left/right directions and a tumbling to rotate the drum for mixing shoes in the drum when the shoe washing course is selected by the second selection unit, wherein the second selection unit has an activated state and a deactivated state, and wherein the controller puts the second selection unit in the activated state when a preset washing course that does not supply steam or heated air to the laundry is selected by the first selection unit and in the deactivated state when a preset washing course that supplies steam or heated air to the laundry is selected by the first selection unit.

* * * * *